US007976339B2

(12) United States Patent
Buck et al.

(10) Patent No.: US 7,976,339 B2
(45) Date of Patent: Jul. 12, 2011

(54) CABLE CONNECTOR WITH BUSHING THAT PERMITS VISUAL VERIFICATION

(75) Inventors: Bruce Dascombe Buck, Niagara On The Lake (CA); Alfred Lee Clifford, Indianapolis, IN (US)

(73) Assignee: IDEAL Industries, Inc., Sycamore, IL (US)

( * ) Notice: Subject to any disclaimer, the term of this patent is extended or adjusted under 35 U.S.C. 154(b) by 0 days.

(21) Appl. No.: 11/969,957

(22) Filed: Jan. 7, 2008

(65) Prior Publication Data

US 2008/0171466 A1 Jul. 17, 2008

Related U.S. Application Data

(60) Provisional application No. 60/884,518, filed on Jan. 11, 2007.

(51) Int. Cl.
*H01R 9/05* (2006.01)

(52) U.S. Cl. ..... 439/578; 439/910

(58) Field of Classification Search ..... 439/578, 439/584, 585, 910
See application file for complete search history.

(56) References Cited

U.S. PATENT DOCUMENTS

| | | | | |
|---|---|---|---|---|
| 2,513,080 | A | 6/1950 | Burtt | |
| 2,897,470 | A | 7/1959 | Klassen | |
| 2,986,720 | A | 5/1961 | Chess | |
| 3,671,926 | A | 6/1972 | Nepovim | |
| 3,847,463 | A | 11/1974 | Hayward | |
| 3,854,789 | A | 12/1974 | Kaplan | |
| 3,997,230 | A | 12/1976 | Secretan | |
| 4,296,986 | A | 10/1981 | Herrmann | |
| 4,339,166 | A | 7/1982 | Dayton | |
| 4,346,958 | A | 8/1982 | Blanchard | |
| 4,405,196 | A | 9/1983 | Fulton | |
| 4,431,255 | A | 2/1984 | Banning | |
| 4,655,159 | A | 4/1987 | McMills | |
| 4,746,305 | A | 5/1988 | Nomura | |
| 4,834,675 | A | 5/1989 | Samchisen | |
| 4,854,893 | A | 8/1989 | Morris | |
| 4,902,246 | A | 2/1990 | Samchisen | |
| 4,952,174 | A | 8/1990 | Sucht | |
| 5,007,861 | A | 4/1991 | Stirling | |
| 5,011,432 | A | 4/1991 | Sucht | |
| 5,154,636 | A | 10/1992 | Vaccaro | |
| 5,439,386 | A | 8/1995 | Ellis | |
| 5,454,730 | A * | 10/1995 | Tozuka | 439/438 |
| 5,470,257 | A | 11/1995 | Szegda | |
| 5,662,489 | A | 9/1997 | Stirling | |
| 5,667,405 | A | 9/1997 | Holliday | |

(Continued)

FOREIGN PATENT DOCUMENTS

| | | |
|---|---|---|
| CA | 2043532 | 10/1994 |

(Continued)

*Primary Examiner* — T C Patel
*Assistant Examiner* — Travis Chambers
(74) *Attorney, Agent, or Firm* — Cook Alex Ltd.

(57) ABSTRACT

Connectors for interconnecting a coaxial cable to an electrical device are disclosed. The connector has an internal body and an external body which are assembled together, and which can be activated to clamp upon and seal to an inserted coaxial cable. The external body includes a bushing made from a transparent, semi-transparent, or translucent material. In some embodiments, the bushing further includes a deformable inner collar that permits the connector to be attached and sealed to cables of varying thickness as are found on common single shield cable, tri-shield cable and quad-shield cable.

21 Claims, 5 Drawing Sheets

U.S. PATENT DOCUMENTS

| | | | | |
|---|---|---|---|---|
| 5,857,872 | A | 1/1999 | Tettinger | |
| 5,863,220 | A | 1/1999 | Holliday | |
| 6,102,738 | A | 8/2000 | Macek et al. | |
| 6,261,126 | B1 | 7/2001 | Stirling | |
| 6,331,123 | B1 | 12/2001 | Rodrigues | |
| 6,520,800 | B1 | 2/2003 | Michelbach et al. | |
| 6,530,807 | B2 | 3/2003 | Rodrigues et al. | |
| 6,575,786 | B1 | 6/2003 | Khemakhem et al. | |
| 6,743,044 | B2 * | 6/2004 | Musolf et al. | 439/490 |
| 6,848,939 | B2 | 2/2005 | Stirling | |
| 7,153,159 | B2 * | 12/2006 | Burris et al. | 439/578 |
| 7,182,639 | B2 * | 2/2007 | Burris | 439/584 |
| 7,422,479 | B2 * | 9/2008 | Chee et al. | 439/584 |

FOREIGN PATENT DOCUMENTS

| | | |
|---|---|---|
| CA | 2179003 | 8/2002 |
| CA | 2207287 | 8/2002 |
| EP | 0 459 825 | 12/1991 |
| GB | 1087228 | 10/1967 |
| WO | WO 90/15454 | 12/1990 |

* cited by examiner

10

CABLE CONNECTOR WITH BUSHING THAT PERMITS VISUAL VERIFICATION

BACKGROUND

Within the cable television industry, RG6 and RG59 cable are the most prevalent standard. Common RG6 and RG59 cable has a central conductor, a dielectric insulator with a single aluminum foil cover, one layer of braided shield surrounding the foil covered dielectric insulator, and a plastic insulating jacket covering the braided shield.

In addition to common RG6 and RG59 cable, so called "tri-shield" and "quad-shield" versions are also increasingly widely used. Tri-shield cable has a second layer of foil which covers the braided shield. Quad-shield cable has both a second layer of foil and a second layer of braided shield over the second layer of foil.

As a result of the additional shielding layers, tri-shield and quad-shield RG6 and RG59 cables have overall thicknesses or diameters greater than that of common RG6 and RG59 cable. The standard diameter of common RG6 cable, for example, is 0.272 inches. For tri-shield RG6 cable the standard diameter is 0.278 inches. For quad-shield RG6 cable the standard diameter is 0.293 inches.

Further, various types of connectors such as F connectors, BNC connectors, and RCA connectors have been developed for use with RG6, RG59, and other types of coaxial cables. A technician commonly attaches a large number of connectors while in the field. Thus, connectors that permit quick, easy and reliable installation are sought by technicians and their employers.

BRIEF DESCRIPTION OF THE DRAWINGS

The invention described herein is illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements.

DETAILED DESCRIPTION

Figure 1:
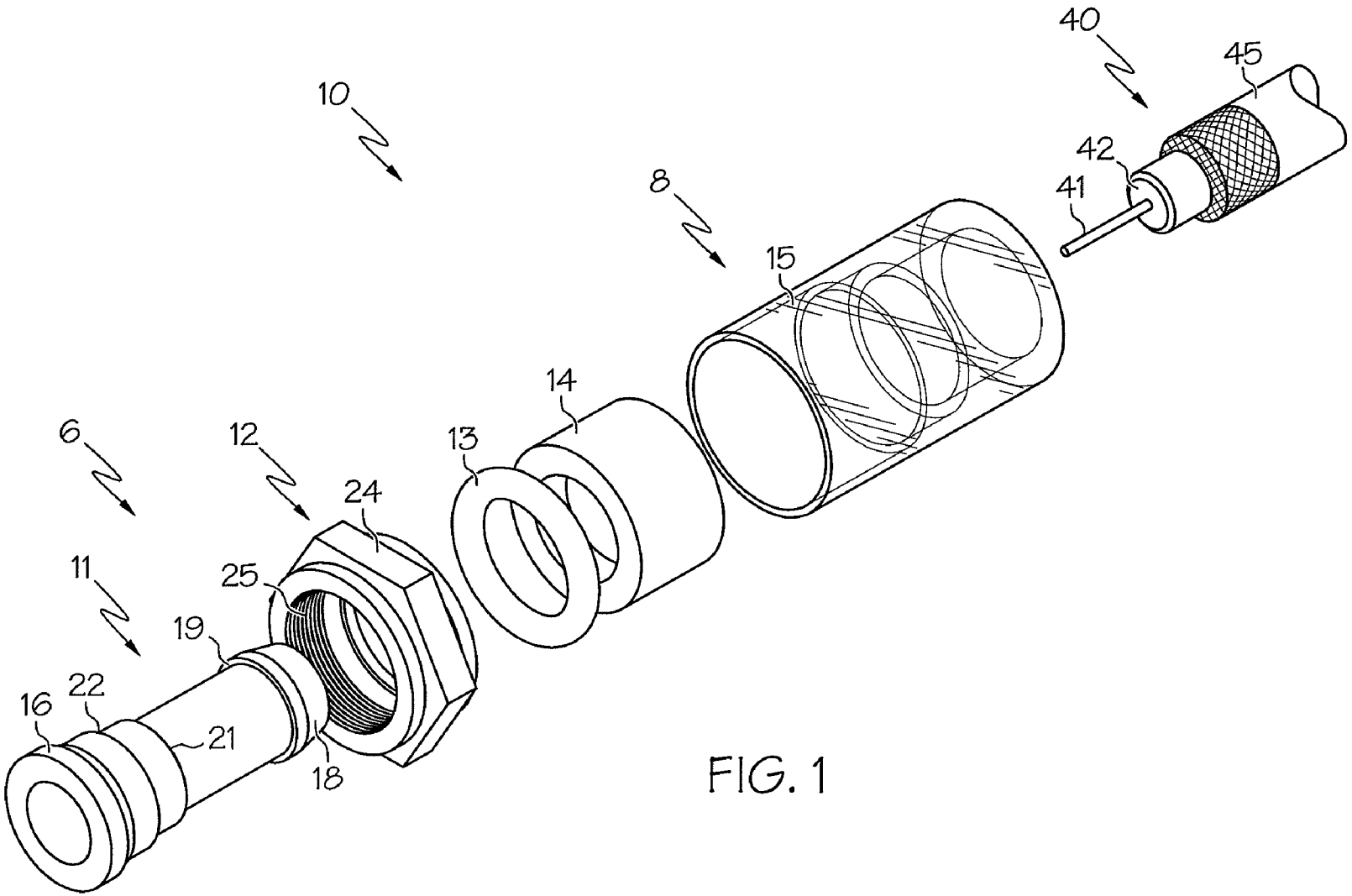
FIG. 1 is an exploded perspective view of a cable connector of the present invention, shown with a coaxial cable.
Figure 2:
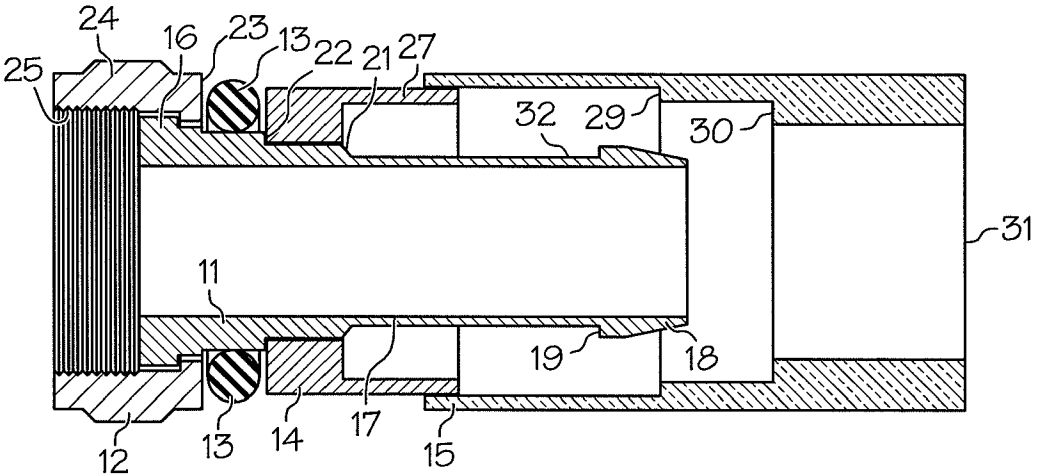
FIG. 2 is a cross-sectional side view of the connector of FIG. 1.

The following description describes a cable connector with a transparent or semi-transparent bushing. References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Referring now to FIGS. 1-5, an embodiment of a connector 10 for a coaxial cable 40 is depicted. The cable 40 comprises a central conductor 41, a dielectric insulator 42 with a foil cover 43, a braided shield 44 and a plastic jacket 45. The connector 10 comprises an internal body 6, an external body 8, and a head 12. The connector 10 is adapted to receive the cable 40 and to tightly hold the cable 40 and form a seal with it by moving the external body relative to the internal body.

In one embodiment, the internal body 6 comprises a mandrill 11, an O-ring 13 and a retainer 14, and the external body 8 comprises a bushing 15. The O-ring 13 is made of a compressible, elastomeric material, such as an EPDM (ethylene propylene diene monomer) rubber, and the mandrill 11, head 12, retainer 14, and bushing 15 are made of a rigid material. In one embodiment, the mandrill 11, head 12 and retainer 14 are made of a metallic material such as brass. The bushing 15 however is made of a transparent, semi-transparent or translucent material such as a transparent polymer. In one embodiment, the bushing 15 comprises a transparent polycarbonate material that is substantially colorless. In another embodiment, the bushing 15 may comprise a transparent, translucent or semi-transparent material having an identifying color. In such an embodiment, connectors 10 may be manufactured with bushings 15 having a variety of colors thus enabling a technician to place different colored connectors 10 on cables to aid in distinguishing cables in multi-cable installations.

It should be appreciated that rigid materials other than those mentioned above may be used to implement the mandrill 11, head 12, retainer 14 and bushing 15. In particular, other transparent, translucent or semi-transparent materials may be used for the bushing 15 which enable a user to view the coaxial cable 40 engaging the mandrill 11 when affixing the connector 10 to the coaxial cable 40. To aid such viewing, the bushing 15 may be constructed from materials which result in the bushing 15 having a transmittance between the outside surface of the bushing 15 and an inner surface of the bushing 15 of greater than 50%, greater than 75%, or greater than 90% thus respectively resulting in greater than 50%, greater than 75%, or greater than 90% of visible light passing through the inner surface to the outer surface of the bushing 15.

The mandrill 11 is generally cylindrical having an enlarged base with a sleeve 17 extending therefrom. A flange 16 projects outwardly from the end of the enlarged base of the mandrill 11. The sleeve 17 has a tapered end 18 with a at least one barb 19. In one embodiment, the sleeve 17 comprises three barbs 19; however, the sleeve 17 may be implemented with a different number of barbs 19 such as a single barb as depicted. The tapered end 18 with the barb 19 is adapted to engage the cable 40 beneath the jacket 45 and the braided shield 44, whether the braided shield 44 is in one layer, as in common and tri-shield RG6 cable, or more layers, as in quad-shield RG6 cable. A bore 20 extends through the mandrill 11 having a diameter to receiving the dielectric 42, foil cover 43 and the conductor 41.

The retainer 14 of the internal body 6 includes a cylindrical wall concentric to the sleeve 17 of the mandrill 11. The retainer 14 defines an annular channel between the cylindrical wall and the sleeve 17 which is dimensioned to receive the jacket 45 and the braided shield 44 of an inserted cable 40, with a gap between the jacket 45 and the wall. The size of the gap depends on the thickness of the cable 40, that is, the number of layers of braided shield.

The retainer 14 of the internal body 6 is generally cylindrical and is fixedly mounted to the mandrill 11. The retainer 14 comprises a base 26 with a wall 27 extending therefrom. The base 26 comprises an internal diameter that allows it to be mounted to the enlarged base of the mandrill 11 and held securely by frictional engagement. A square shoulder 22 on the enlarged base of the mandrill 11 provides a seat for the base 26 of the retainer 14. The cylindrical wall 27 is concentric to the sleeve 17 of the mandrill 11. The cylindrical wall 27 and the sleeve 17 define an annular channel which is dimensioned to receive the jacket 45 and the braided shield 44 of an inserted cable 40, with a gap 32 between the jacket 45 and the wall 27. The size of the gap 32 depends on the thickness of the cable 40, that is, the number of layers of braided shield.

FIGS. 1-5 depict the head 12 as a nut of an F connector. In such an embodiment, the head 12 may be rotatably mounted to the mandrill 11. The head 12 may comprise a collar 23 that engages the flange 16 of the mandrill 11 to permit free rotation between the head 12 and the mandrill 11. The head 12 may further comprise hexagonal flats 24 and internal threads 25 to engage a mating connection and operatively connect the cable 40 thereto.

While the head 12 is depicted as a nut of an F connector in FIGS. 1-5, the head 12 may conform with other types of connectors. For example, the head 12 may comprise an RCA connector head to operatively connect the cable 40 to a mating RCA connection or may comprise a BNC connector head to operatively connect the cable to a mating BNC connection, thus resulting in a RCA connector or a BNC connector respectively instead of the depicted F connector.

The collar 23 of the head 12 and the enlarged base of the mandrill 11 and the base 26 of the retainer 14 together define an annular groove 28 in which sits the O-ring 13. The O-ring 13 is of a size and dimension to seat in the annular groove 28, and to extend slightly beyond the retainer 14.

The bushing 15 of the external body 8 is in the form of a gripping bushing that is mounted to the connector 10 surrounding a portion of the mandrill 11 and concentric to the mandrill 11. At one end, the bushing 15 has a mouth 31 of a diameter to receive the cable 40. The other end of the bushing 15 is adapted to be mounted to the retainer 14 with a close fitting but slideable engagement.

Figure 5:
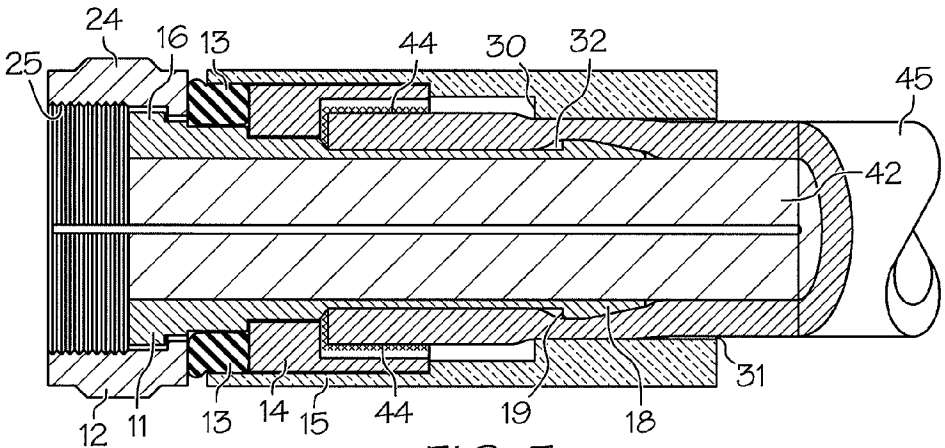
FIG. 5 is a cross-sectional side view of the same connector as in FIG. 4, with the outer bushing of the connector having been moved from its original position, in which the connector can receive the coaxial cable, to its final position, in which the connector tightly holds the inserted coaxial cable and forms a seal therewith.

The bushing 15 has a stepped internal surface. A first step 29 reduces the internal diameter of the bushing 15 from a dimension corresponding to the outside diameter of the retainer 14 to a dimension corresponding to the inside diameter of the wall 27 of the retainer 14. The first step 29 of the bushing 15 seats against the end of the wall 27 of the retainer 14 when the bushing 15 has been activated to slide into its clamping position, as shown in FIG. 5. A second step 30 on the internal surface of the bushing 15 defines the depth of the mouth 31.

The connector 10 is assembled by first mounting the head 12 to the mandrill 11, then mounting the O-ring 13, and subsequently mounting the retainer 14, which prevents the O-ring 13 and the head 12 from subsequent removal from the mandrill 11. Finally, the bushing 15 is mounted to the retainer 14 as shown best in FIG. 2.

In mounting the connector 10 to the coaxial cable 40, the cable 40 is first prepared by exposing a length of the central conductor 41, and also stripping a further length of the dielectric 42 and its foil-cover 43. The braided shield 44 is cut slightly longer than the jacket 45 and is folded back over the edge thereof, as shown in FIG. 1.

Figure 3:
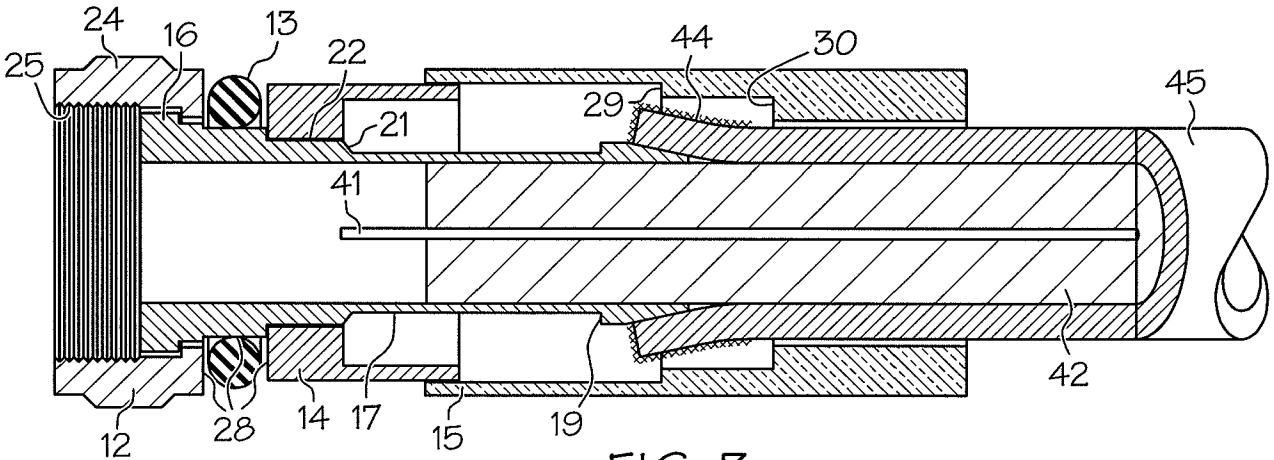
FIG. 3 is a cross-sectional side view of the same connector as shown in FIG. 2, with a coaxial cable having been inserted therein.
Figure 4:
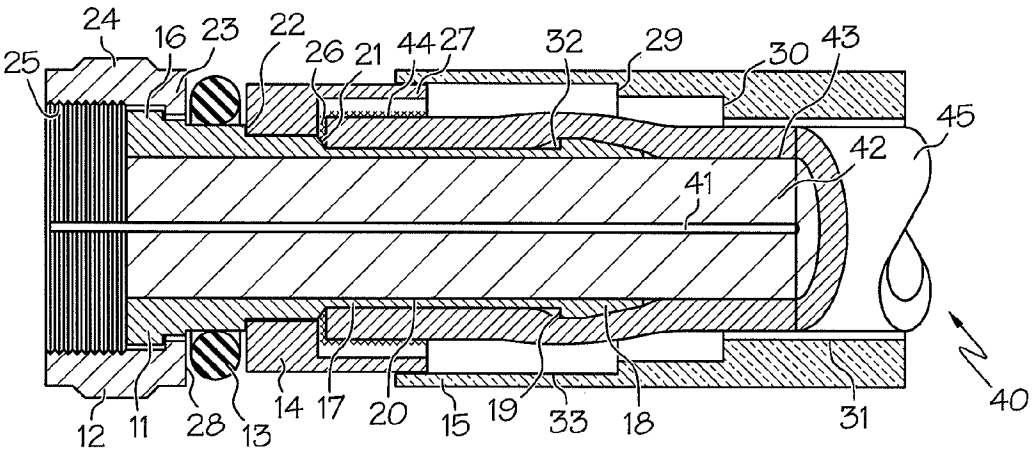
FIG. 4 is a cross-sectional side view of the same connector as in FIG. 3, with the coaxial cable having been inserted further therein.

As shown in FIGS. 3 and 4, the cable 40 is inserted into the connector 10 such that the conductor 41, the dielectric 42 and the foil 43 are received within the bore 20 of the mandrill 11. The tapered end 18 of the mandrill slides beneath the braided shield 44 and the jacket 45 of the cable 40. The barb 19 on the sleeve 17 of the mandrill 11 resists subsequent removal of the cable 40 from the mandrill 11.

The trimmed end of the jacket 45 of the cable 40 and the folded back portion of the braided shield 44 encounter a flared shoulder 21 on the sleeve 17 of the mandrill 11. A cavity 33 between the internal surfaces of the bushing 15 and retainer 14 and the external surface of the sleeve 17 accommodates the jacket 45 and the folded back portion of the braided shield 44 of the cable 40.

When the cable 40 has been fully inserted into the connector 10 such that the conductor 41 extends into the head 12, the connector is placed in a levered squeezing tool (not shown) by which the bushing 15 is forced to slide over the retainer 14 and the O-ring 13.

As the bushing is moved, the gap 32 between the bushing 15 and the tapered end 18 of the mandrill 11 is reduced, as shown in FIG. 5. The second step 30 of the bushing 15 impinges upon the cable 40, squeezing the braided shield 44 and jacket 45 between the mouth 31 of the bushing 15 and the tapered end 18 of the mandrill 11 such that when the bushing 15 is collapsed fully onto the retainer 14, with the first step 29 seated upon the end of the wall 27, the cable 40 is clamped tightly by the connector 10 with a moisture seal formed between the jacket 45 of the cable 40 and the mouth 31 of the bushing 15.

As can be appreciated from FIG. 3-5 and the above description, due to the transparent or semi-transparent nature of the bushing 15, a user may visually verify the interaction between the connector 10 and the cable 40 by looking through the outer wall of the bushing 15. For example, the user may verify that the sleeve 17 of the mandrill 11 slides beneath the braided shield 44 and the jacket 45 of the cable 40. The visual feedback enabled by the bushing 15 not only increases the reliability of the connection in that the user may visually verify proper operation, but further eases installation due to the user being able to see what he is doing.

Referring now to FIGS. 6-9, another embodiment of a connector 110 is depicted. The connector 110 comprises an internal body 106, and external body 108, and a head 112. The connector 110 is adapted to receive and to tightly hold and seal to cables of different thicknesses, such as common RG6 cable, tri-shield RG6, and quad-shield RG6 cable, thus permitting a single embodiment of the connector 110 to be used with a range of different cables thicknesses. It should be appreciated that a single connector that may be used with a variety of cable thicknesses makes a technician's job easier as the technician need only carry a supply of the single connector and need not worry about whether he has the correct connector size for the cable being used.

In one embodiment, the internal body 106 comprises a mandrill 111, an O-ring 113, and a retainer 114, and the external body 108 comprises a bushing 115 and an internal collar 135. The O-ring 113 is made of a compressible, elastomeric material, such as an EPDM (ethylene propylene diene monomer) rubber. The collar 135 is made of a deformable material such as Delrin.RTM., an acetal resin available from E.I. Dupont de Nemours and Company. The mandrill 111, head 112, retainer 114, and bushing 115 are all made of a rigid material in a manner similar to the mandrill 11, head 12, retainer 14 and bushing 15 of the connector 10 described above in regard to FIGS. 1-5. In particular, the bushing 115 in one embodiment is made from a transparent, semi-transparent, or translucent material that permits a technician to visually verify internal operation of the connector 110 during installation by looking through the outer surface of the bushing 115.

The mandrill 111 is generally cylindrical having an enlarged base with a sleeve 117 extending therefrom. A flange 116 projects outwardly from the end of the enlarged base of the mandrill 111. The sleeve 117 has a tapered end 118 with a barb 119. The tapered end 118 with the barb 119 is adapted to engage the cable 40 beneath the jacket 45 and the braided shield 44, whether the braided shield 44 is in one layer, as in common and tri-shield RG6 cable, or more layers, as in quad-shield RG6 cable. A bore 120 extends through the mandrill 111 having a diameter to receive the dielectric 42, foil cover 43 and the conductor 41.

FIGS. 6-9 depict the head 112 as a nut of an F connector. In such an embodiment, the head 112 may be rotatably mounted to the mandrill 111. The head 112 may comprise an inwardly projecting flange 123 that engages the flange 116 of the mandrill 111 to permit free rotation between the head 112 and the mandrill 111. The head 112 is provided with internal threads 125 and hexagonal flats 124. The head 112 may further comprise hexagonal flats 124 and internal threads 125 to engage a mating connection and to operatively connect the cable 140 thereto.

While the head 112 is depicted as a nut of an F connector in FIGS. 6-9, the head 112 may conform with other types of connectors. For example, the head 112 may comprise an RCA connector head to operatively connect the cable 140 to a mating RCA connection or may comprise a BNC connector head to operatively connect the cable 140 to a mating BNC connection, thus resulting in a connector 110 that conforms with a RCA connector or a BNC connector respectively instead of the depicted F connector.

The enlarged base 121 of the mandrill 111 has an annular groove 128 in which sits the O-ring 113. The O-ring 113 is of a size and dimension to seat in the annular groove 128, and to contact sealingly with the flange 123 of the nut member 112.

The retainer 114 is generally cylindrical and is fixedly mounted to the mandrill 111. The retainer 114 has a base 126 with a wall 127 extending therefrom. The base 126 has an internal diameter that allows it to be mounted to the enlarged base 121 of the mandrill 111 and held securely by frictional engagement. The sleeve 117 of the mandrill 111 and the wall 127 of the retainer 114 define an annular cavity 132 with a tapered entry 133.

The bushing 115 is also cylindrical and has a mouth 131 at one end dimensioned to receive the coaxial cable 140. The other end of the bushing 115 is adapted to be mounted to the retainer 114 with a close fitting slideable engagement.

Figure 9:
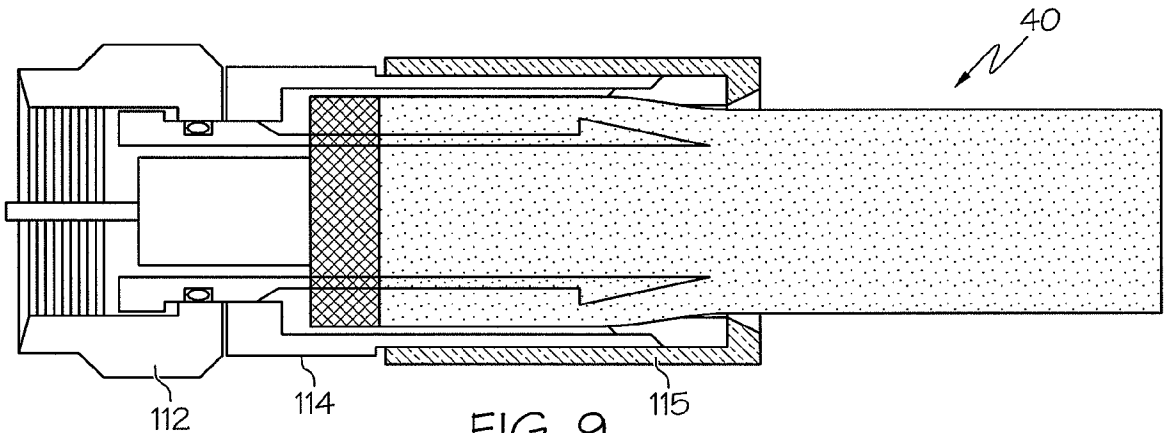
FIG. 9 is a cross-sectional side view of the same connector as in FIG. 8, with the outer bushing of the connector having been moved from its original position, in which the connector can receive the coaxial cable, to its final position, in which the connector tightly holds the inserted coaxial cable and forms a seal therewith.

The wall 127 of the retainer 114 has a stepped external surface such that a step 129 provides a positive stop for the bushing 115 to seat against when the bushing 115 has been activated to slide into its clamping position, as shown in FIG. 9.

The bushing 115 has an internal collar 135 made of a deformable plastic material, such as Delrin.RTM. resin or high density polyethylene (HDPE). The collar 135 is generally cylindrical and is retained within the bushing proximal the mouth 131. The outward facing rim 139 of the collar 135 is generally flat and seats at the mouth end of the bushing 115. The inward facing rim 130 of the collar 135 has a tapered edge 136. The collar 135 also has an external annular groove 137 that provides a weakness point about which the collar 135 deforms during operation to accommodate cables of different diameters.

Figure 6:
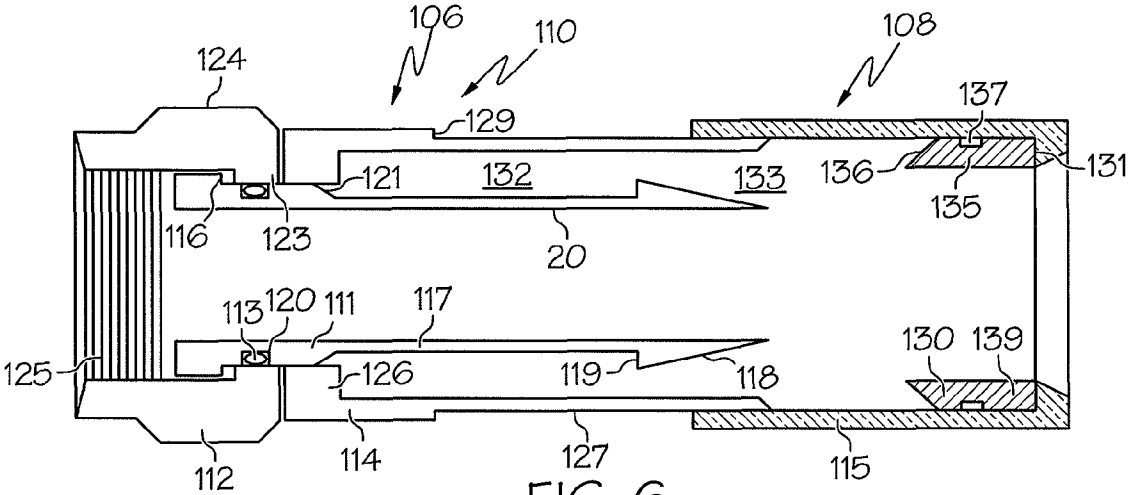
FIG. 6 is a cross-sectional side view of a cable connector of the present invention.

The connector 110 is assembled by first mounting the O-ring 113 to the mandrill 111, then mounting the head, and subsequently mounting the retainer 114, which prevents the O-ring 113 and the head 112 from subsequent removal from the mandrill 111. The collar 135 is inserted into the bushing 115. Finally, the bushing 115 is mounted to the retainer 114 as shown in FIG. 6.

In mounting the connector 110 to the coaxial cable 40, the cable is first prepared by exposing a length of the central conductor 41, and also stripping a further length of the dielectric 42 and foil-cover 43. The braided shield 44 is cut slightly longer than the jacket 45 and is folded back over the edge thereof, as shown in FIG. 7.

Figure 7:
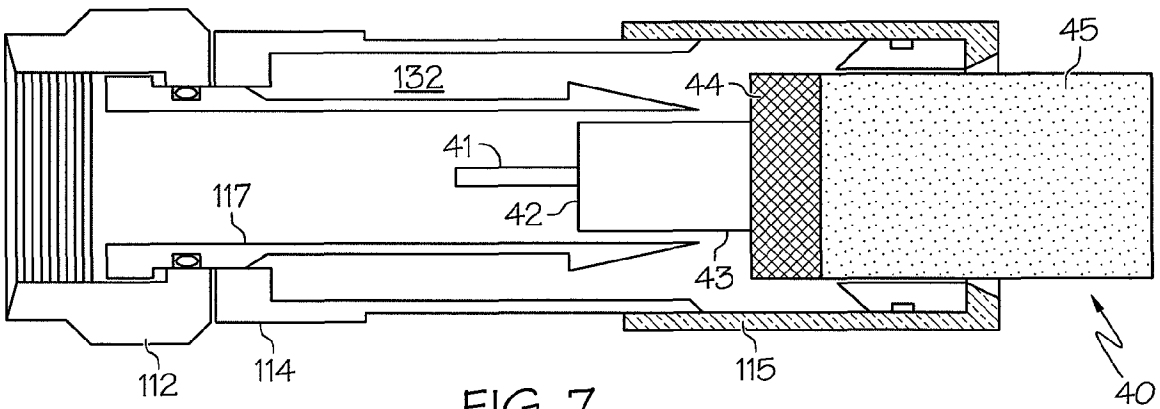
FIG. 7 is a cross-sectional side view of the same connector as shown in FIG. 6, with a coaxial cable having been inserted therein.
Figure 8:
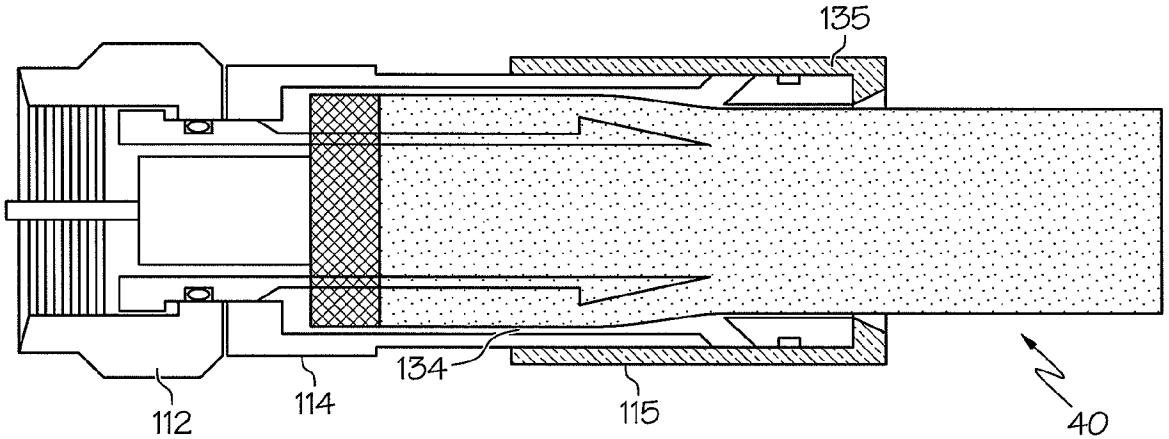
FIG. 8 is a cross-sectional side view of the same connector as in FIG. 7, with the coaxial cable having been inserted further therein.

Attachment of the connector 110 to the cable is shown in FIGS. 7-9. The prepared cable 40 is first inserted into the connector 110 such that the conductor 41, the dielectric 42 and the foil 43 are received within the bore 120 of the mandrill 111. The tapered end 118 of the mandrill 111 slides beneath the braided shield 44 and the jacket 45 of the cable 40. The barb 119 on the sleeve 117 of the mandrill 111 resists subsequent removal of the cable 40 from the mandrill 111.

The trimmed end of the jacket 45 of the cable 40 and the folded back portion of the braided shield 44 are accommodated within the annular cavity 132, entering at the tapered entry 133.

When the cable 40 has been fully inserted into the connector 110 such that the conductor 141 extends into the nut member 112, the connector 110 is placed in a levered squeezing tool (not shown) which forces the bushing 115 to slide over the retainer 114.

As the bushing 115 is moved, the tapered edge 136 of the inner collar is inserted in the entry 133 of the annular cavity 132, between the end 118 of the sleeve 117 of the mandrill 111 and the end of the wall 127 of the retainer 114. The inward facing rim 138 of the inner collar 135 is deformed to fill the gap 134 between the jacket 45 of the cable 40 and the retainer wall 127, such that the cable 40 is clamped tightly and sealed by the connector 110 when the bushing 115 is squeezed fully onto the retainer 114. The collar 135 deforms so as completely to fill the gap 134 between the cable 40 and the retainer wall 127 whether the cable 40 has either one or two layers of braided shield 44 beneath the outer jacket 45. The annular groove 137 of the collar 135 provides a region of weakness to promote the desired deformation of the collar 135 when the bushing 115 is compressed within the retainer 114.

While certain features of the invention have been described with reference to various embodiments, the description is not intended to be construed in a limiting sense. Various modifications of the described embodiments, as well as other embodiments of the invention, which are apparent to persons skilled in the art to which the invention pertains are deemed to lie within the spirit and scope of the invention. For example, the retainer and mandrill may be an integral body. The configuration of the connector and its component parts may also be modified. The O-ring may be replaced with a different type of seal between the mandrill and the head, and the placement of such O-ring or other seals may be altered. Moreover, the connectors may be dimensioned for use with regular, tri-shield, and/or quad-shield cables whether RG59, RG6 or another cable type.

What is claimed is:

1. A connector for a coaxial cable that has a dielectric insulator encasing a central conductor, at least one shield layer around the dielectric insulator, and an outer jacket over the at least one shield layer, the connector comprising:

a mandrill comprising a sleeve that defines a bore to receive the dielectric insulator of the coaxial cable, the sleeve being engageable with the cable beneath the at least one shield layer;

a head engageable with the mandrill, the head being adapted to operatively connect the cable to a mating connection;

a retainer attached to the mandrill, the retainer comprising a generally cylindrical wall concentric to the sleeve of the mandrill; and a bushing having a mouth at one end, the mouth having a first diameter to receive the cable, the other end of the bushing having a second diameter slideably engaged with the retainer, the bushing permitting visual verification of receipt of the cable and engagement of the sleeve beneath the at least one shield layer of the cable as the cable is moved through the bushing into the mandrill, wherein the sleeve of the mandrill and the mouth of the bushing bearing a mechanical load by squeezing the jacket of the cable between the mouth of the bushing and the sleeve of the mandrill to affix the connector to the cable as the bushing is slideably moved from a first position remote from the head to a second position proximal the head.

2. The connector of claim 1, wherein the bushing is transparent.

3. The connector of claim 1, wherein the bushing is semi-transparent.

4. The connector of claim 1, wherein the bushing is translucent.

5. The connector of claim 1, wherein the bushing is constructed to have a transmittance between an outside surface of the bushing and an inner surface of the bushing of greater than 50% resulting in greater than 50% of visible light passing through the inner surface to the outer surface of the bushing.

6. The connector of claim 1, wherein the bushing is constructed to have a transmittance between an outside surface of the bushing and an inner surface of the bushing of greater than 75% resulting in greater than 75% of visible light passing through the inner surface to the outer surface of the bushing.

7. The connector of claim 1, wherein the bushing is constructed to have a transmittance between an outside surface of the bushing and an inner surface of the bushing of greater than 90% resulting in greater than 90% of visible light passing through the inner surface to the outer surface of the bushing.

8. The connector of claim 1, wherein the bushing has a color selected from a variety of colors for identification purposes.

9. The connector of claim 1, wherein the head comprises an F connector head.

10. The connector of claim 1, wherein the head comprises an RCA connector head.

11. The connector of claim 1, further comprising a collar in the bushing, wherein the collar is to deform as the bushing is slideably moved from the first position to the second position to further squeeze the jacket of the cable.

12. The connector of claim 1, wherein the sleeve is to squeeze the jacket of the cable against the bushing as the bushing is moved from the first position to the second position.

13. The connector of claim 1, wherein the sleeve is to squeeze the jacket of the cable between the sleeve and the retainer as the bushing is moved from the first position to the second position.

14. A connector for a coaxial cable that has a dielectric insulator encasing a central conductor, at least one shield layer around the dielectric insulator, and an outer jacket over the at least one shield layer, the connector comprising:

a mandrill comprising a sleeve that defines a bore to receive the dielectric insulator of the coaxial cable, the sleeve being engageable with the cable beneath the at least one shield layer;

a head engageable with the mandrill, the head being adapted to operatively connect the cable to a mating connection;

a retainer attached to the mandrill, the retainer comprising a generally cylindrical wall concentric to the sleeve of the mandrill; and a bushing having a mouth at one end, the mouth having a first diameter to receive the cable, the other end of the bushing having a second diameter slideably engaged with the retainer, the bushing comprising a material that permits visible light to pass between an outer surface and an inner surface of the bushing, wherein the sleeve of the mandrill and the mouth of the bushing bearing a mechanical load by squeezing the jacket of the cable between the mouth of the bushing and the sleeve of the mandrill to affix the connector to the cable as the bushing is slideably moved from a first position remote from the head to a second position proximal the head.

15. The connector of claim 14, wherein the bushing is made from a transparent polymer.

16. The connector of claim 14, wherein the bushing is made from a semi-transparent polymer.

17. The connector of claim 14, wherein the bushing is constructed to have a transmittance between the outside surface of the bushing and the inner surface of the bushing of greater than 50% resulting in greater than 50% of visible light passing through the inner surface to the outer surface of the bushing.

18. The connector of claim 14, wherein the bushing is constructed to have a transmittance between the outside surface of the bushing and the inner surface of the bushing of greater than 75% resulting in greater than 75% of visible light passing through the inner surface to the outer surface of the bushing.

19. The connector of claim 14, wherein the bushing is constructed to have a transmittance between the outside surface of the bushing and the inner surface of the bushing of greater than 90% resulting in greater than 90% of visible light passing through the inner surface to the outer surface of the bushing.

20. The connector of claim 14, wherein the bushing is made from a translucent polymer.

21. The connector of claim 20, wherein the head comprises a BNC connector head.

* * * * *